US006726551B2

(12) United States Patent
Friel, Sr.

(10) Patent No.: US 6,726,551 B2
(45) Date of Patent: Apr. 27, 2004

(54) MANUAL KNIFE SHARPENER WITH ANGLE CONTROL

(75) Inventor: Daniel D. Friel, Sr., Greenville, DE (US)

(73) Assignee: Edgecraft Corporation, Avondale, PA (US)

( * ) Notice: Subject to any disclaimer, the term of this patent is extended or adjusted under 35 U.S.C. 154(b) by 0 days.

(21) Appl. No.: 10/023,190

(22) Filed: Dec. 18, 2001

(65) Prior Publication Data

US 2002/0094768 A1 Jul. 18, 2002

Related U.S. Application Data

(60) Provisional application No. 60/260,980, filed on Jan. 11, 2001.

(51) Int. Cl.[7] ..... B24B 23/00

(52) U.S. Cl. ..... 451/344; 451/45; 451/552; 451/555; 451/556; 30/298.4; 76/84; 76/82; 76/88

(58) Field of Search ..... 451/45, 552, 555, 451/556, 557, 558, 344; 30/298.4; 76/84, 82, 88

(56) References Cited

U.S. PATENT DOCUMENTS 4,716,689 A * 1/1988 Friel ..... 451/45
4,897,965 A * 2/1990 Friel ..... 451/282
5,390,431 A * 2/1995 Friel ..... 451/45
5,404,679 A * 4/1995 Friel et al. ..... 451/312
5,478,272 A * 12/1995 Cozzini et al. ..... 451/540
5,582,535 A * 12/1996 Friel ..... 451/45
5,620,359 A * 4/1997 Harrison et al. ..... 451/45
6,267,652 B1 * 7/2001 Friel et al. ..... 451/177

* cited by examiner

*Primary Examiner*—Joseph J. Hail, III
*Assistant Examiner*—Alvin J Grant
(74) *Attorney, Agent, or Firm*—Connolly Bove Lodge & Hutz

(57) ABSTRACT

A manual knife sharpener is provided with angle control structure. The structure includes a guide member having a guide surface which forms an angle with the abrasive surface of the sharpening member. When the blade is inserted into the space between the abrasive surface and the guide surface the blade presses against the guide surface to displace the guide surface linearly in a direction perpendicular to the guide surface so that the movement is a lateral movement in the same plane without any pivoting or twisting of the guide member. Thus, the angle between the guide surface and the abrasive surface remains constant regardless of the extent of displacement of the guide member.

31 Claims, 4 Drawing Sheets

MANUAL KNIFE SHARPENER WITH ANGLE CONTROL

CROSS-REFERENCE TO RELATED APPLICATION

This application is based upon provisional application Ser. No. 60/260,980, filed Jan. 11, 2001.

BACKGROUND OF THE INVENTION

A wide variety of manual knife sharpeners have been used for centuries but most of these have been disappointing because they did not provide any precise means to control the sharpening angle. The importance of angle control to the creation of ultra sharp knife edges is recognized in, for example, U.S. Pat. Nos. 5,390,431 and 4,627,194.

Manual sharpeners have been described by others where control of the sharpening angle is obtained by use of clamping devices or blade carriers in which the blade is mounted in a mechanism and physically restrained so that the facet of the blade edge is restrained to remain parallel to the abrasive sharpening surface as the clamping device or carrier is moved in a predetermined direction relative to the abrasive sharpening surface. A major disadvantage of using clamping devices or carriers to control sharpening angle is the awkwardness and inconvenience of the devices themselves.

One example of such blade carriers, U.S. Pat. No. 2,652,667 by C. D. Arnold, describes a sharpener where the blade is placed in a knife blade holder which moves in a direction parallel to the surface of the sharpening stone while the blade facet is in contact with the abrasive stone. The blade is wedged into the blade holder that sets the blade at a predetermined angle to the abrasive surface. Another example is U.S. Pat. No. 3,882,642 by C. S. Sykes, which describes a different knife holder that moves in a direction parallel to the surface of the sharpening stone. The blade is held in fixed non-sliding contact with the holder as the holder is moved in a direction parallel to the abrasive surface. AS the holder moves the knife edge moves with it in contact with the abrasive surface.

SUMMARY OF THE INVENTION

This application relates to techniques to incorporate convenient yet precise angle control to a variety of manual knife sharpeners.

Advantages of manual sharpeners as a class are their simplicity, portability, and ease of use. The new and novel guide structure described here preserves these advantages while permitting control of the blade to be totally manual and where its control is entirely free of any clamping device or carrier, yet one is able to maintain a consistent sharpening angle stroke-after-stroke. This new concept can be implemented in a wide variety of physical configurations while incorporating any of the well-known abrasive surfaces.

This novel structure of angle control provides a displaceable physical linear guide surface against which the face of the blade is manually positioned and manually aligned in sliding contact with that surface as the facet of that blade is manually caused to traverse along an abrasive surface. The axis of the displaceable linear surface is restrained to move only in a direction perpendicular to its linear guide surface so that the axis of the displaced linear guide surface, however, displaced will always remain parallel to its previous alignment. By manually maintaining the face of the blade in full sliding contact and in alignment with the linear guide surface as the facet of the blade edge is moved across or along the abrasive surface, excellent control of the sharpening angle is insured and an extremely sharp edge is created. The grit size and the type of abrasive can be selected to be more or less aggressive depending on the dullness of the edge. By changing the angle between the linear guide surface and the plane of the abrasive surface the sharpening angle of the blade can be varied to suit the users need. Sharpening of a blade can be conducted in one or more stages of progressively larger sharpening angle and finer grits so as to establish one or more edge facet angles and improve the perfection of the ultimate edge.

The linear guide surface can be located in front of the abrasive, as seen by the user, behind the abrasive, or in the middle of the abrasive plane. In the last case the abrasive would be located in front of and behind the linear guide surface.

THE DRAWINGS

DETAILED DESCRIPTION

The various drawings illustrate sharpeners having a guide surface located near an abrasive surface so that the blade can be disposed against the guide surface and moved across the abrasive surface to sharpen the blade. In the various embodiments illustrated herein the linear guide surface is movable in a direction perpendicular to its surface plane and at the same time the linear guide surface in all stages of displacement remains parallel to its initial plane. Thus, there is lateral movement of the linear guide surface without any angular movement. This motion is in contradistinction to motions where the linear guide surface for the face of the blade is part of a cumbersome holder or carrier and moves in its entirety parallel to the plane of the abrasive surface at the blade contact point.

Figure 2:
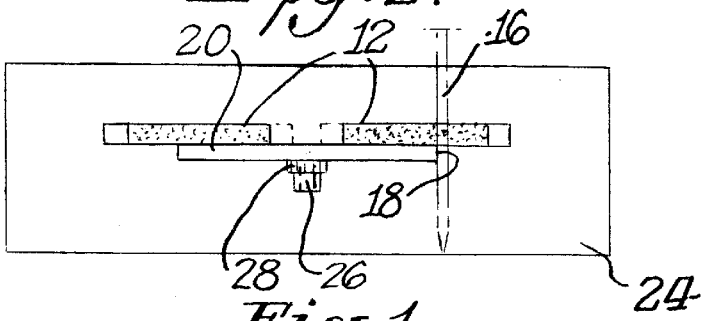
FIG. 2 is a top plan view of the sharpener shown in FIG. 1.
Figure 1:
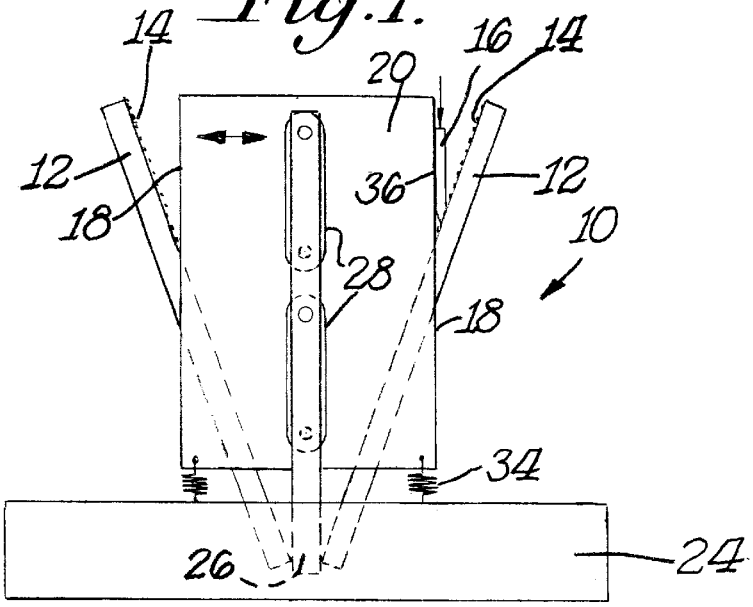
FIG. 1 is a front elevational view of a manual knife sharpener in accordance with this invention.
Figure 3:
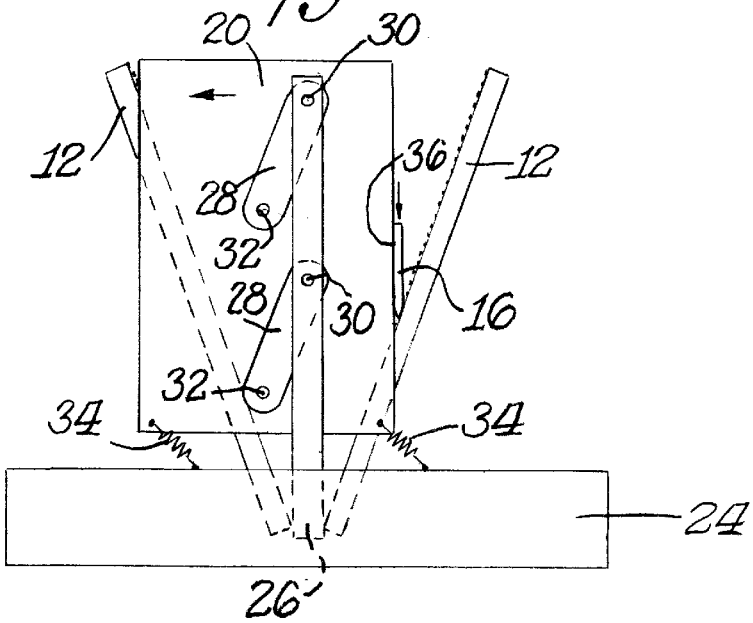
FIG. 3 is a front elevational view similar to FIG. 1 in a different phase of operation.

FIGS. 1–3 illustrate a manual knife sharpener 10 in accordance with one embodiment of this invention. The portion illustrated is directed to the relationship between the guide structure and the sharpening structure. Various other features such as a housing are not illustrated.

Figure 4:
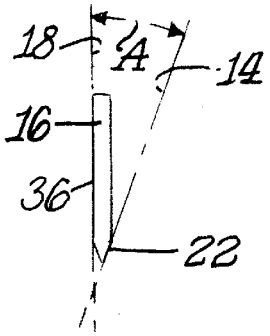
FIG. 4 is a schematic view showing the relationship between a knife and portions of the sharpener shown in FIGS. 1–3.

As shown in FIGS. 1–3 a pair of abrasive sharpening members 12, 12 is provided angled toward each other. Each sharpening member has an abrasive surface 14, 14. A knife 16 would be placed as shown in a space formed between the abrasive surface 14 and the linear guide surface 18 of a guide member 20. As illustrated in FIG. 4 the angle A between the abrasive surface 16 and the linear guide surface 18 would determine the angle at which the blade facet 22 would be sharpened. Each sharpening member 12, 12 may be disposed at the same or a different angle than the other member and/or may include different forms of abrasive surfaces to vary the sharpening action. The sharpening member can be shaped to have a circular, oval, rectangular or triangular cross section for example, and various faces or areas can be coated with different abrasive grit sizes so that alternate faces can be presented, if desired, to the blade facet when placed in contact with that member.

As illustrated in FIGS. 1–3 a fixed support structure 24 is provided which fixedly mounts support post 26. Guide 20 is mounted to support post 26 by links 28, 28 which are pivotally connected at one end by pivot pin 30 to support post 26 and pivotally connected at their opposite end by pin 32 to guide 20. Springs 34 mounted to support structure 24 and guide 20 tend to hold or bias the guide 20 in a central condition when no force is applied to the guide 20. Counterweights can be used instead of springs to serve the same function.

As shown by comparing FIGS. 1 and 3 when the knife blade 16 is lowered into the space between guide surface 18 and abrasive surface 14 and held with the face of the blade in intimate contact with guide surface 18 a force is created pushing laterally against guide 20. This results in the face 36 of the blade 16 being held in intimate sliding contact with the guiding surface 18 while the blade is moved downwardly. The blade edge facet 22 remains in good contact with abrasive surface 14 and is accordingly reconfigured and sharpened. Importantly, as the blade 16 moves along the guide 20, as shown in FIG. 3, the blade displaces the guide 20 to the left. The plane of the guiding surface, however, always remains vertical. Thus, the movement of guide 20 is solely a lateral movement without any pivoting or angular changes relative to the abrasive surface. The blade face 36 is always held in sliding contact against the guide surface 18 and its edge facet 22 is always presented to the plane of the abrasive surface 14 at the same angle.

Because guide 20 is mounted to fixed support post 10 by means of equal length pivoted links 28, 28 lateral displacement of guide 20 is possible. FIG. 3 shows the guide 20 to be moved to the left with the restoring springs 34, 34 also being moved. When the knife blade 16 is placed in the space between the left hand guide surface 18 and the left hand abrasive surface 14, guide 20 moves in the same manner as illustrated in FIG. 3, but in the opposite direction, namely toward the right. The facet of blade 16 opposite to that of facet 22 would then be sharpened in the same manner previously described.

Figure 5:
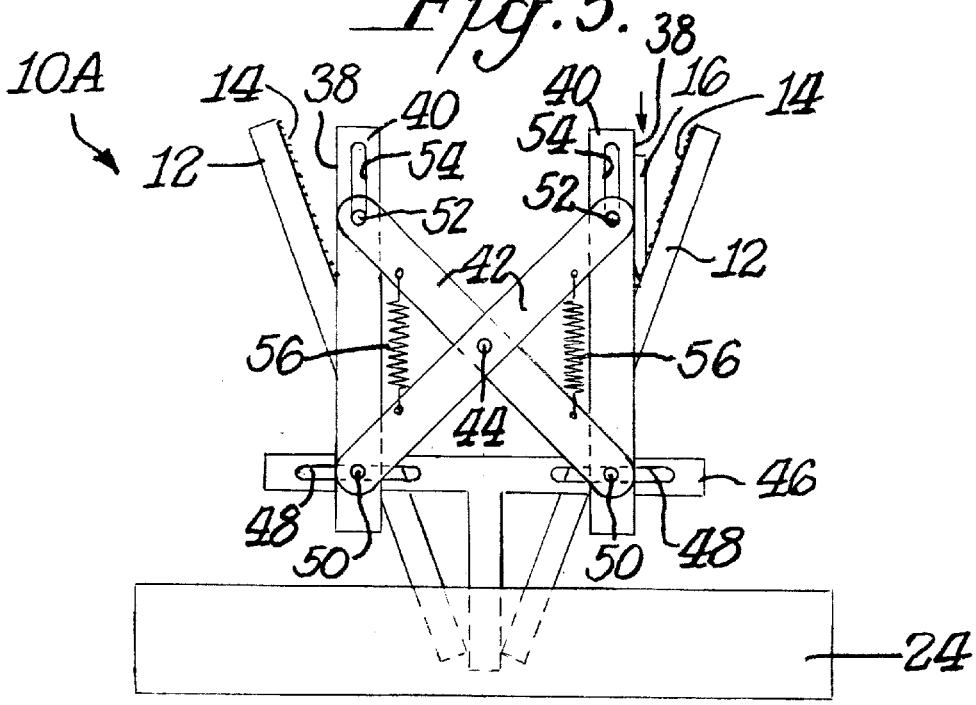
FIG. 5 is a view similar to FIG. 1 of a modified sharpener in accordance with this invention.
Figure 6:
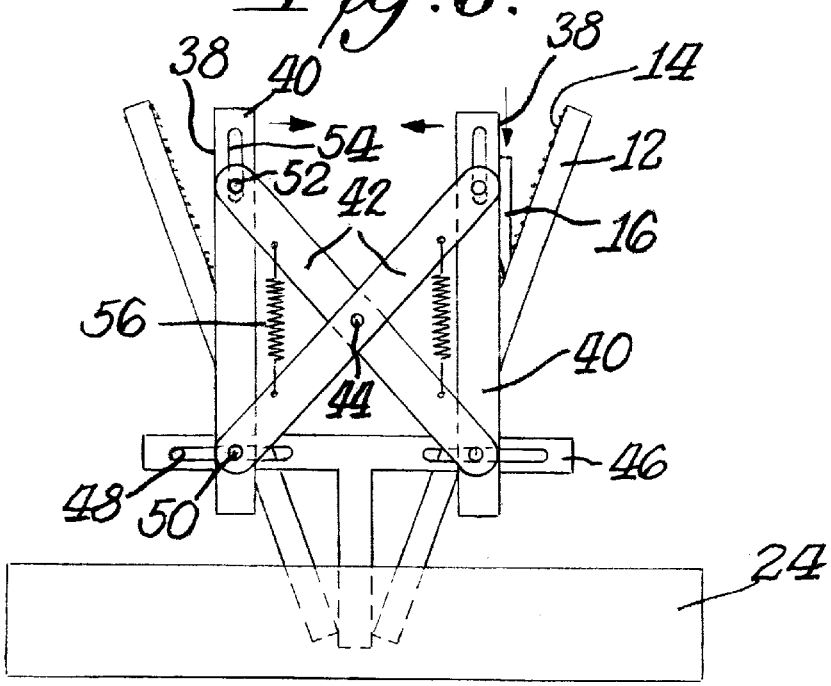
FIG. 6 is a view similar to FIG. 5 showing the sharpener of FIG. 5 in a different phase of operation.

FIGS. 5–6 show a modified form of sharpener 10A. As shown therein, a pair of abrasive sharpening members 12, 12 is provided, each of which has an abrasive surface 14. The blade 16 would be placed in the space formed between the abrasive surface 14 and a guide surface 38 on a guide member 40. As illustrated, two such guide members 40, 40 are provided each with its linear guide surface 38. The two spaced guide members 40, 40 are connected together by intersecting links 42, 42 pivoted at a central location by pin 44. A T-shaped support post 46 is fixedly mounted to base or fixed support 24. Support post 46 includes a pair of elongated slots 48, 48. One end of each link 42, 42 is provided with a pin or other member 50 to slide in a respective slot 48. The opposite end of each link 42, 42 is provided with a pin or other member 52, 52 to slide in an elongated slot 54 in a respective guide member 40. A pair of springs 56, 56 connects the sets of links 42,42 together as illustrated in FIG. 5 to hold the pins 52, 52 in their lower most position in slots 54, 54.

When the blade 16 is inserted into the space between abrasive surface 14 and guide surface 38 the respective guide member 40 is moved toward the left as shown in FIGS. 5–6 which causes the links 42, 42 to pivot and draw the two guide members 40, 40 closer together as shown in FIG. 6. This results in the same type of action described with respect to FIGS. 1–4 where the guide surface is moved linearly in a transverse direction while the blade is held manually in sliding contact with the abrasive member 12 and guide 40 during all phases of displacement of guide 40.

While the invention has been described with respect to the abrasive surface 14 being in a nominally vertical configuration, it is to be understood that the various embodiments of this invention described herein could be practiced when the entire mechanism is rotated through any angle including 90°. By rotating the entire mechanism the abrasive surface could be horizontal. The location of springs can be adjusted to optimize performance of the guide mechanism depending on its angular reorientation. Thus, in accordance with the invention it is not critical that the components be in a nominally vertical configuration so long as the movement or displacement of the guide member remains in the same angular orientation whether completely vertical, completely horizontal or an intermediate angle without any rotation or pivoting of the guide surface during its displacement.

Figure 8:
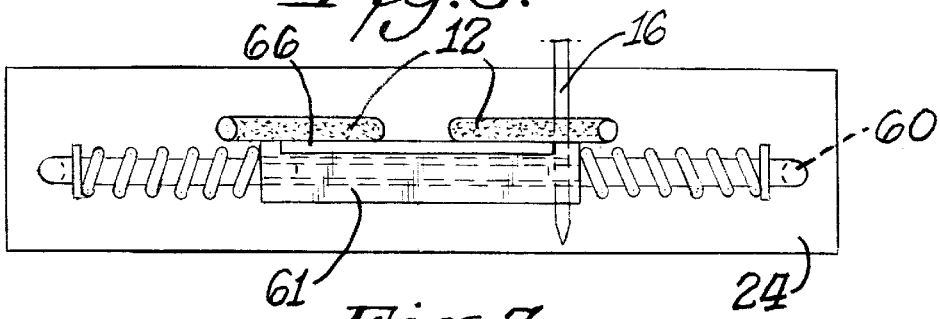
FIG. 8 is a top plan view of the sharpener shown in FIG. 7.
Figure 7:
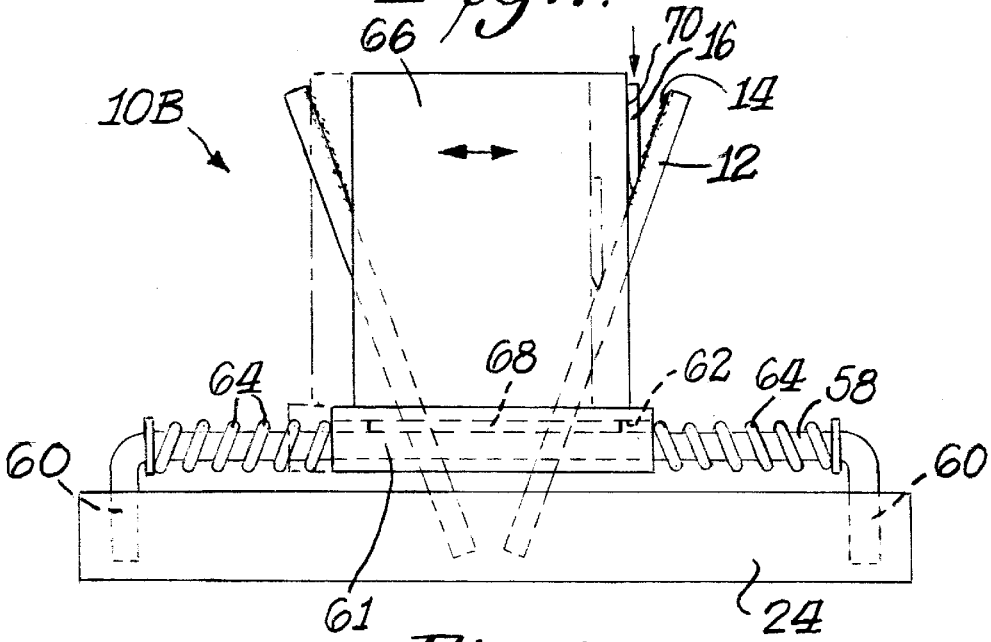
FIG. 7 is a front elevational view of yet another form of sharpener in accordance with this invention.

FIGS. 7–8 illustrate yet a further sharpener 10B in accordance with this invention. As shown therein, a stationary member or fixed slide rod 58 is mounted to fixed base 24 by having the ends 60 secured to the base 24 in any suitable manner. A sleeve in the form of a support block 61 is slidably mounted on fixed slide rod 58. A return spring 64, 64 is located on each side of support block or slide bearing 61 to urge the support block into a centrally located position. Guide member 66 can be secured to support block 61 by any of a variety of means including adhesives or by means of a key 68 at the end of guide member 66. Key 68 is located in keyway 62. Support block 61 may slidably move on slide rod 58 without any rotational motion by any suitable interconnection such as a key/keyway or by slide rod 58 being of non-circular cross section and block 61 having a complementary shaped passage through which slide rod 58 extends. Because of the interconnection of guide member 66 to block 61, movement of guide member 66 carries block 61 with it.

When a blade 16 is inserted into the space between abrasive surface 14 and guide surface 70 as shown in solid in FIG. 7, the guide member 66 is nominally in its central condition. As the blade is moved downwardly, as shown in phantom in FIG. 7, the downward movement causes the guide member 66 and support block 61 to shift toward the left as also shown in phantom in FIG. 7. During this movement spring 64 on the lefthand portion would be compressed. When the opposite facet of blade 16 is to be sharpened and the blade is inserted in the lefthand portion of sharpener 10B the reverse motions would take place.

Figure 9:
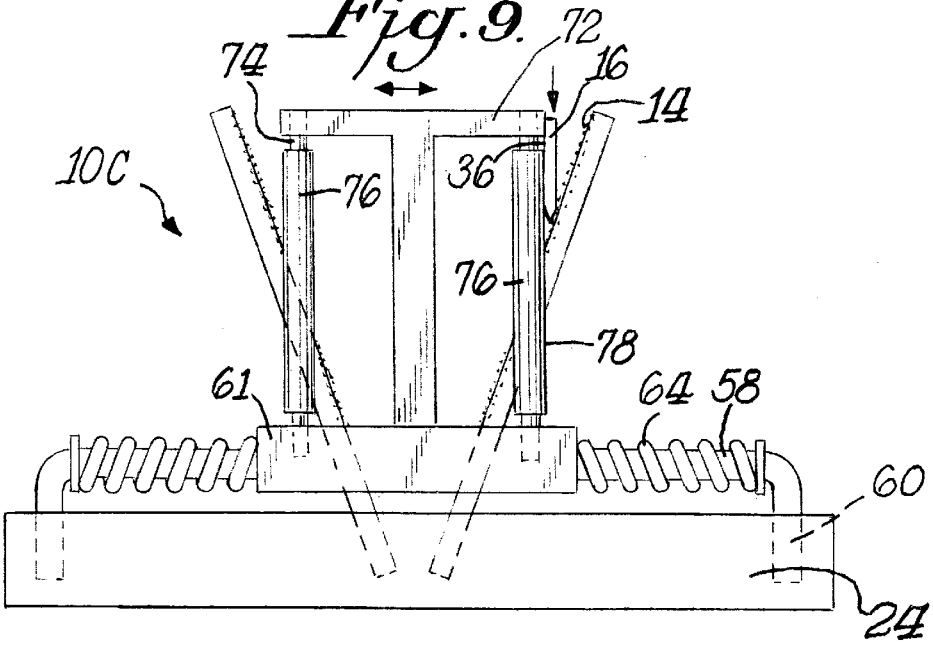
FIG. 9 is a view similar to FIGS. 1, 5 and 7 of still yet another sharpener in accordance with this invention.

FIG. 9 shows yet another sharpener 10C in accordance with this invention which is similar to the sharpener of FIGS. 7–8. As shown in FIG. 9 instead of a single guide member which may be in plate-like form in FIGS. 7–8, the guide member 72 of FIG. 9 is a generally T-shaped support fixedly mounted at its lower end to support block 61. Block 61 would be mounted to slide rod 58 in the same manner as described with respect to FIG. 7. A shaft 74 is located at each side of guide member 72. Each shaft 74 is journaled at its upper end to guide member 72 and at its lower end into slide block 61 in any suitable manner. In the embodiment of FIG. 9 each shaft 74 extends through a guide roller 76. Thus, the guide surface is actually the outer surface 78 of elongated roller 76.

The manner of operation of sharpener 10C would otherwise be similar to that of sharpener 10B in FIGS. 7–8. With the sharpener 10C of FIG. 9 displacement of the entire guide member 72 would result when the blade 16 is moved into the space created by the abrasive surface 14 and the rolling outer surface 78 of rollers 76. Thus, the utilization of a sleeve bearing or slide block 61 on the slide rod 58 permits the guide member 72 of FIG. 9 to be laterally displaced when the force from the blade 16 causes the sleeve bearing 61 to which guide member 72 is rigidly attached to move. The guide member 72 is thus displaced perpendicular to its guide surface and the excellent alignment of the sleeve bearing 61 on the slide rod 58 ensures that the guiding surface 78 is always parallel to its last and to any future position created by its perpendicular displacement.

Springs 64 are used to restore the guide 72 to its neutral position whenever the knife 16 is removed. Springs are also used with the other embodiments shown herein to assist in maintaining parallel motion of the guide surfaces.

Design of the surface of the linear guide surface is important to minimize scratching of that face of the blade which is held against the face of the linear guide surface while the edge facet 22 is moved in contact with the abrasive surface 14. Using a flocked coating or a polymer coating on the linear guide surface can minimize scratching. Rollers, such as rollers 76, can be used to form or constitute the linear guide surface. Such rollers will rotate as the knife face is moved linearly against their surface, thus minimizing or eliminating scratching of the face of the blade. The surface of the roller can, if desired, be plastic, rubberized or flocked to minimize scratching.

FIG. 9 shows such variation where linear rollers 76 mounted on the guide structure or guide member 72 serve as the guiding surface 78. The face 36 of the blade held in sliding contact with that surface 78 and the rolling action of the roller 76 reduces friction against the face 36 of the blade as the blade is moved forward between the guide surface 78 and the abrasive surface 14. A series of small rollers or balls can be used similarly as an alternative to a single roller.

Figure 11:
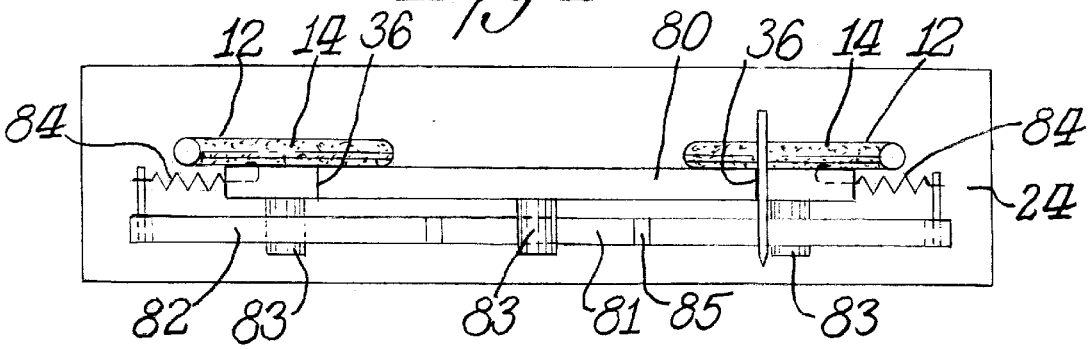
FIG. 11 is a top plan view of the sharpener shown in FIG. 10.
Figure 10:
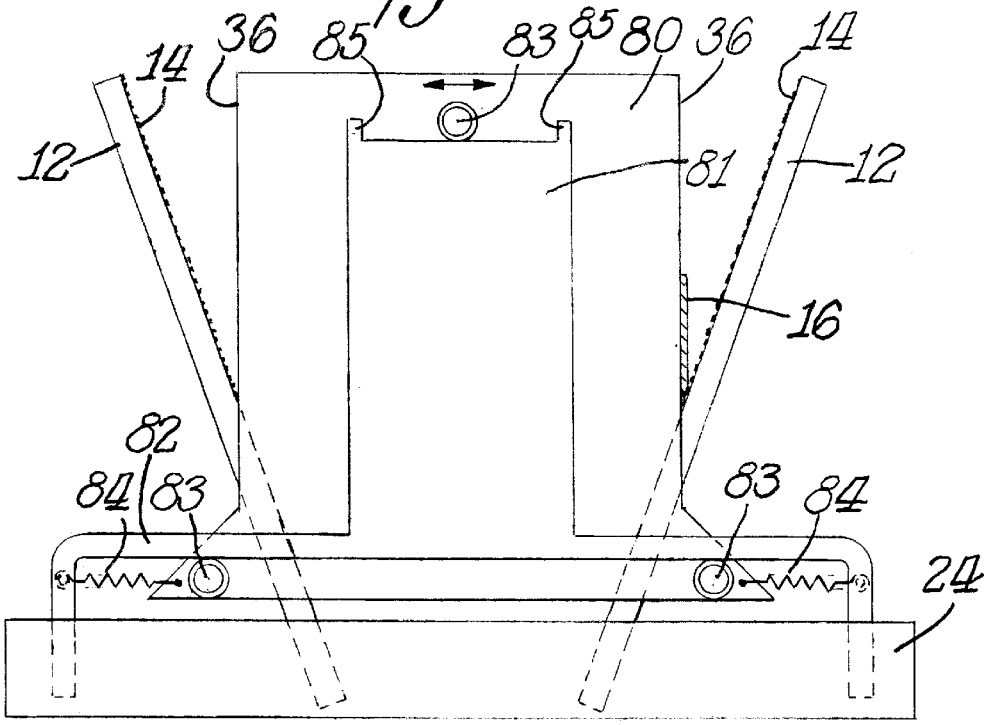
FIG. 10 is a front elevational view of still yet another embodiment of this invention.

Still another physical arrangement of a sharpener with a guide member 80 is shown in FIGS. 10 and 11. This guide member 80 with parallel guide surfaces 36 is supported by three rollers 83 that are attached to and move with the guide member 80. The rollers 83 ride along support structure 81, one roller above central support structure 81 and two below structure lateral extensions 82 attached to base 24. The triangular configuration of the rollers insures that the guide member can move only in a direction perpendicular to the guide surfaces 36. The circumference of the roller 83 can be grooved in order to retain the rollers securely on support structure 81,82. Blade 16 is inserted between guide surface 36 and the abrasive surface 14 with the face of the blade parallel to and in contact with the guide surface 36. As the blade is moved lower beyond the point of contact as shown in FIG. 10, the guide member 80 will shift to the left. Conversely when inserted and moved along the opposite guide surface 36 the guide member 80 will move to the right. Springs 84 attached to guide member 80 and support extensions 82 will act to restore the guide member to a centered position when the blade is removed. Stops 85 on support structure 81 can be used to limit travel of the guide member to that distance between such stops.

In any of the described configurations, a magnetic material or structure can be aligned with the guide surface to provide an appropriate magnetic attraction of the face of the blade to the guide surface thereby assisting the operator maintain good contact of the blade face with the guide surface. The magnitude of the magnetic attraction should not be so large as to impede ready movement of the blade face along the guide surface.

The various mechanisms thus described are examples of structures that can be used to allow motion of the guiding surface perpendicular to the axis of that surface while insuring that the guide surface remains parallel to its prior orientation.

What is claimed is:

1. A sharpener for a blade with a cutting edge facet on at least one face of the blade to form a cutting edge comprising a support structure mounting at least one elongated abrasive member, said elongated abrasive member having an abrasive surface, a blade guiding mechanism including an extended displaceable guide surface mounted adjacent to said elongated abrasive member laterally outwardly of said abrasive surface, said guide surface physically extending through the projected plane of the facet when the facet is in contact with said abrasive surface of said elongated abrasive member, said displaceable guide surface providing a sliding contact with the face of the blade to position and maintain the facet of the blade at a desired sharpening angle and in sustained contact with said abrasive surface of said elongated abrasive member as said displaceable guide surface is moved by manual pressure applied to the face of the blade to move said displaceable guide surface in a direction perpendicular to its guide surface, and said guide surface being maintained parallel to its rest position when said guide surface is displaced from one position to another position.

2. The sharpener according to claim 1, wherein said guiding mechanism includes positioning structure to establish the rest position of said displaceable guide surface and to provide a restorating force when said guide surface is moved from a rest position to return said guide surface to said rest position.

3. The sharpener according to claim 2, wherein said positioning structure is at least one spring.

4. The sharpener according to claim 1 wherein said abrasive member and said guide surface comprise a first set, a second abrasive member and a second guide surface comprising a second set mounted as a mirror image to said first set, and said guiding mechanism also controlling the movement of said guide surface of said second set.

5. The sharpener according to claim 1 including a stationary member mounted to a base, said guiding mechanism including a slide bearing mounted on said stationary member, and said displaceable guide surface being mounted to said slide bearing.

6. The sharpener according to claim 5 including at least one spring member mounted on said stationary member on each side of said slide bearing to urge said slide bearing to its rest position.

7. The sharpener according to claim 6 wherein said stationary member is a rod secured to a base, and said slide bearing being a sleeve slidably mounted around said rod.

8. The sharpener according to claim 1 wherein said displaceable guide surface is the outer surface of a rotatable roller mounted to said guiding mechanism.

9. The sharpener according to claim 1 wherein said displaceable guide surface is an edge of a plate.

10. The sharpener according to claim 1 wherein a magnet structure is aligned with said displaceable guide surface.

11. A sharpener according to claim 1 wherein said abrasive member is fixedly and non-rotationally mounted.

12. A sharpener for a blade with a cutting edge facet on at least on face of the blade to form a cutting edge comprising a support structure for mounting at least one inclined elongated abrasive member, said elongated abrasive member having an abrasive surface, a blade guiding mechanism including an extended displaceable nominally vertical guide surface mounted adjacent to said elongated abrasive member laterally outwardly of said abrasive surface, said guide surface physically extending through a plane extending horizontally through the facet when the facet is in contact with said abrasive surface of said inclined elongated abrasive member, said displaceable guide surface providing a sliding contact for the face of the blade to position and maintain the facet of the blade at a desired sharpening angle and in nominally sustained contact with said surface of said elongated abrasive member as said displaceable guide surface is displaced by manual pressure applied to the face of the blade to move said displaceable guide surface in a direction perpendicular to its guide surface, and said guide surface being maintained parallel to its rest position when said guide surface is displaced from one position to another position.

13. The sharpener according to claim 12 wherein said inclined abrasive member and said nominally vertical guide surface comprises a first set, a second inclined abrasive member and a second nominally vertical guide surface comprising a second set mounted as a mirror image to said first set, and said guiding mechanism controlling the movement of said guide surface of said second set.

14. A sharpener according to claim 13 comprising a vertical structure mounted on said support structure, and said vertical structure comprising at least one roller to provide support for said first and second displaceable nominally vertical guide surfaces and to control alignment of said guide surfaces in a manner that allows each of said guide surfaces to be displaced by manual pressure applied to said guide surfaces by said face of said blade to move each of said displaceable guide surfaces in a direction perpendicular to its said guide surface.

15. A sharpener according to claim 12 including at least one spring connected to said vertical guide surfaces and to said support structure to restore said vertical guide surfaces to a rest position when the face of the blade is removed from contact with said vertical guide surface.

16. A sharpener according to claim 12 wherein said abrasive member is fixedly and non-movably mounted.

17. A manual sharpener for a blade with a cutting edge facet on at least one face of the blade to form a cutting edge comprising a support structure mounting a first elongated abrasive member and a mirror image second elongated abrasive member spaced from each other, each of said elongated abrasive members having an abrasive surface, a blade guiding mechanism including a first extended displaceable guide surface and a mirror image second extended displaceable guide surface, said first extended guide surface being mounted adjacent to said first elongated abrasive member laterally outwardly of said abrasive surface of said first elongated abrasive surface, said second extended guide surface being mounted adjacent to said second elongated abrasive member laterally outwardly of said abrasive surface of said second elongated abrasive member, each of said guide surfaces physically extending through the projected plane of the facet when the facet is in contact with its abrasive surface of its elongated abrasive member, said guide surface being interconnected for joint movement whereby when there is movement of one of said guide surfaces toward and away from its abrasive surface there is movement of the other of said guide surfaces, each of said guide surfaces providing a sliding contact with the face of the blade to position and maintain the facet of the blade at a desired sharpening angle and in sustained contact with its abrasive surface of its elongated abrasive member as said guide surface is moved by manual pressure applied to the face of the blade to move said guide surface in a direction perpendicular to said guide surface from one position to another, and each of said guide surfaces being maintained parallel to its rest position when said guide surface is displaced from one position to another.

18. The sharpener according to claim 17 wherein said guide mechanism includes a plate having a pair of parallel edges, each of said edges comprising a respective one of said displaceable guide surfaces, and said guide mechanism being reciprocally mounted to move toward and away from each of said projected planes of said first abrasive member and said second abrasive member in accordance with which of said first and said second abrasive member is used for the sharpener of the blade.

19. The sharpener according to claim 18 wherein said guiding mechanism includes a pair of freely movable elongated parallel supporting links, and each of said links being pivotally attached at one end to said plate and pivotally attached at its other end to said support structure.

20. The sharpener according to claim 19 wherein said support structure includes a base and a fixed member rigidly mounted to said base, and said links being pivotally mounted to said fixed member.

21. The sharpener according to claim 20 wherein said links are aligned with each other and with said fixed member centrally between said first and said second abrasive members when said sharpener is in its rest position.

22. The sharpener according to claim 17 including a spring positioning structure to establish the rest position of said displaceable guide surfaces and to provide a restoring force when said each guide surface is moved from said rest position to return said guide surface to it rest position.

23. The sharpener according to claim 17 wherein said guiding mechanism comprises two spaced plates, each of said plates having an outer edge to comprise said first and said second guide surfaces, each of said guide surfaces disposed toward its respective abrasive surface said guiding mechanism including a pair of links pivoted together centrally along the length of each of said lengths, each of said links being mounted at one end to a respective one of said plates, and each of said links being mounted at its other end to said support structure.

24. The sharpener according to claim 23 wherein said support structure comprises a base, a post mounted to said base, said post having spaced aligned slots, said links being mounted to said post by pins slidably mounted in said spaced aligned slots, each of said plates having an elongated slot, said elongated slots in said plates being parallel to each other, each of said links being mounted to its respective plate by a pin slidably mounted in said elongated slot of said plate, and said links being slidably mounted to said spaced aligned slots.

25. The sharpener according to claim 24 wherein spring members bias and links to a neutral condition.

26. The sharpener according to claim 17 including a stationary member mounted to a base, said guiding mechanism including a slide bearing mounted on said stationary member, and said displaceable guide surfaces being mounted to said slide bearing.

27. The sharpener according to claim 26 including a spring member mounted on said stationary member on each side of said slide bearing to urge said slide bearing to its rest position.

28. The sharpener according to claim 27 wherein said stationary member is a rod secured to said base, and said slide bearing being a sleeve slidably mounted around said rod.

29. The sharpener to claim 28 wherein said guide member has a pair of elongated rollers mounted parallel to each other, and each of said rollers having an outer surface which comprises said displaceable guide surface.

30. The sharpener according to claim 17 wherein each of said displaceable guide surfaces is the outer surface of a rotatable roller mounted to said blade guiding mechanism.

31. A sharpener according to claim 30 wherein said support structure includes an upstanding central portion and lateral extensions, and said rollers comprising rollers mounted to said lateral extensions.

* * * * *